US005887942A

United States Patent [19]

Allegro, Jr.

[11] Patent Number: 5,887,942

[45] **Date of Patent: *Mar. 30, 1999**

[54] TRASH COLLECTION FOR FOLDING SEAT FACILITIES

[76] Inventor: James Allegro, Jr., 2200 Corporate Blvd., NW. #304, Boca Raton, Fla. 33431

[ * ] Notice: This patent issued on a continued prosecution application filed under 37 CFR 1.53(d), and is subject to the twenty year patent term provisions of 35 U.S.C. 154(a)(2).

[21] Appl. No.: 587,110

[22] Filed: Jan. 11, 1996

[51] Int. Cl.[6] ..... A47C 7/62

[52] U.S. Cl. ..... 297/188.12; 297/188.08; 363/11

[58] Field of Search ..... 383/11, 61, 63, 383/84, 86, 88, 89; 297/188.1, 188.2, 188.08, 188.12, 188.13, 188.01; 224/928

[56] References Cited

U.S. PATENT DOCUMENTS

| | | | |
|---|---|---|---|
| D. 315,494 | 3/1991 | Latham . | |
| 2,861,735 | 11/1958 | Faltin | 383/11 |
| 2,865,433 | 12/1958 | Warner | 297/188.1 |
| 3,109,578 | 11/1963 | Davis | 383/11 |
| 3,149,771 | 9/1964 | Pearl | 383/89 |
| 3,151,909 | 10/1964 | Gerdetz | 297/188.2 |
| 3,346,883 | 10/1967 | Ersek | 383/11 X |
| 3,508,700 | 4/1970 | Kelly | 383/11 |
| 3,510,052 | 5/1970 | Ruda | 383/11 |
| 3,632,029 | 1/1972 | Sonner | 224/928 X |
| 3,908,853 | 9/1975 | Keesling . | |
| 4,252,372 | 2/1981 | Harder, Jr. . | |
| 4,335,769 | 6/1982 | McManus | 383/11 |
| 4,538,783 | 9/1985 | Stobbe . | |
| 4,810,031 | 3/1989 | Patterson . | |
| 4,919,546 | 4/1990 | Imazeki et al. . | |
| 5,020,751 | 6/1991 | Larkin . | |
| 5,027,965 | 7/1991 | Dumars | 383/63 X |
| 5,088,667 | 2/1992 | Olson . | |
| 5,119,968 | 6/1992 | Carlson . | |
| 5,383,727 | 1/1995 | Rife | 383/11 |
| 5,409,291 | 4/1995 | Lamb et al. | 297/188.06 X |
| 5,417,495 | 5/1995 | Branson | 383/84 X |
| 5,573,288 | 11/1996 | Raffensperger | 297/188.12 |

FOREIGN PATENT DOCUMENTS

| | | | |
|---|---|---|---|
| 1171746 | 1/1959 | France | 297/188.13 |

*Primary Examiner*—Peter R. Brown
*Attorney, Agent, or Firm*—Myron E. Click

[57] ABSTRACT

An assembly and a system for improving the cleanliness of a facility. A flexible trash receptacle uses a trash bag which is attached to the bottom of the folding seat via an extension flap and seat attachment. When the seat is in the closed position, the trash bag flexes back toward the seat to allow unobstructed passage. When the seat is lowered to the open position, the trash bag flexes forward and hangs down from the bottom of the folding seat. The extension flap allows the user to have improved access to the opening in the trash bag by distancing the opening in the trash bag from the bottom of the seat. In one embodiment, the trash receptacle is located closer to the forward edge of the folding seat by using an adhesive on the front side of the seat attachment. Optional sealing methods such as plastic zip lock seals can be used to securely close the trash receptacle when full. Also, the same adhesives used to attach the trash receptacle to the folding seat can be used to seal the trash receptacle after use. Another optional feature is the placement of advertising or other indicia on the surface of the trash receptacle.

14 Claims, 13 Drawing Sheets

TRASH COLLECTION FOR FOLDING SEAT FACILITIES

BACKGROUND OF THE INVENTION

1. Technical Field

The present invention relates to trash collection. In particular, it relates to disposable trash bags which are secured to a folding seat.

2. Background Art

Many types of public facilities use folding seats which enable the facility owner to achieve greater seating density while allowing easy access to seating. Folding seats, such as those discussed herein, are found in arenas, civic centers, auditoriums, theaters, stadiums, etc., and they may be designed for indoor or outdoor use. For ease of discussion, seats found in any of these varied facilities will be referred to as arena seats.

A problem associated with the high density seating provided by arena seats is the absence of a suitable place to discard rubbish. This is due to the limited space available between adjacent rows. In many public facilities, even indoor ones such as arenas or theaters, patrons will drop rubbish on the floor rather than carry it from the seating area to a conventional trash receptacle.

Prior art attempts to address this problem have concentrated on encouraging patrons to handle trash properly by using trash bags where possible. Bracket assemblies which can be attached to the rear of the arena seat in front of the patron and which have the ability to hold a trash container are known. Unfortunately, this approach has proven to be impractical for several reasons. First, the high density nature of seating in public facilities does not provide adequate room between the patron and the seat in front of a patron to comfortably accommodate a bracket assembly capable of holding a trash bag or trash container. A trash container located in front of the patron will interfere with the patrons movement, present an obstacle to the patron or others trying to move past the patron, possibly damage the patron's clothing, or get knocked off the seat back by the patron or by someone moving past the patron.

The prior art has failed to provide a system or an assembly using a trash receptacle which is inexpensive, which is easy to install and remove, which provides convenient access when desired and which is unobtrusively positioned when not in use.

SUMMARY OF THE INVENTION

The present invention solves the foregoing problems by providing a flexible trash receptacle which attaches to a folding arena seat. In one embodiment, a flexible trash receptacle is used wherein a trash bag attaches to the bottom of the folding seat via an extension flap and seat attachment. When the seat is in the closed or raised position, the trash bag flexes back toward the seat to allow unobstructed passage. When the seat is lowered to the open or lowered position, the trash bag flexes forward and hangs downwardly from the bottom of the folding arena seat. The extension flap allows the user to have improved access to the opening in the trash bag by distancing the opening in the trash bag from the bottom of the seat. In one embodiment, the trash receptacle may be located closer to the forward edge of the folding seat by using an adhesive on the front side of the seat attachment. Optional sealing methods such as plastic complementary rib and groove seals can be used to securely close the trash receptacle when full. Also, when adhesives, double stick tape, etc. are used to attach the trash receptacle to the folding arena seat, the same adhesives can be used to seal the trash receptacle after use. Another optional feature is the placement of advertising or other indicia on the surface of the trash receptacle.

DESCRIPTION OF THE PREFERRED EMBODIMENT

Figure 1:
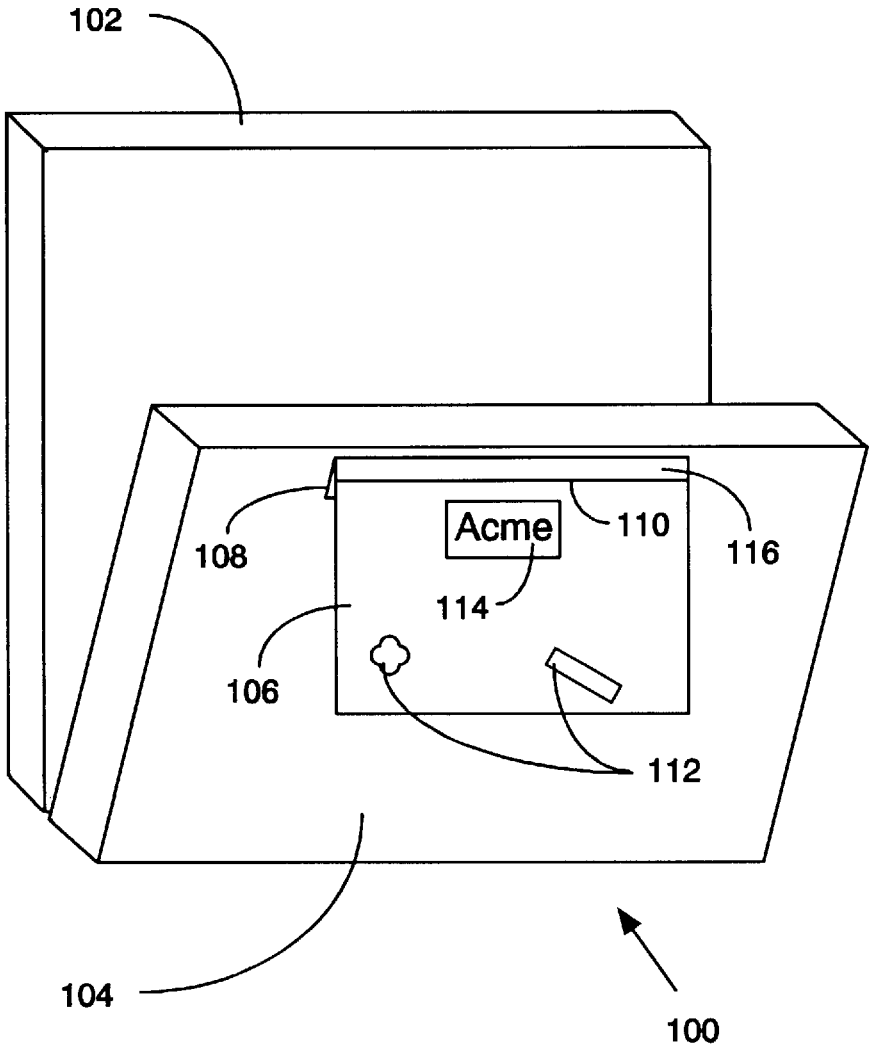
FIG. 1 is a diagram showing a front perspective view of a preferred embodiment of the invention with the folding seat in the closed or raised position and an adhesive seat attachment.

Referring to FIG. 1, this figure illustrates a conventional arena seat 100 with a fixed back 102 and a folding seat 104. The seat 104 has an upper seating side, a lower underside, and a front edge side. This figure shows folding seat 104 in the closed (or upright) position. The trash receptacle 106 has a rear panel and a front panel defining a trash aperture 110, and is attached to the underside of folding seat 104 by seat attachment 108. In the preferred embodiment, seat attachment 108 uses an adhesive to attach to folding seat 104. However, alternative attachment means can be used. For example, double stick tape, mechanical clamps, support rods used in conjunction with sleeves, etc. can be used in place of the adhesive. However, adhesive attachment is more desirable due to its low cost and minimal space requirements.

An optional feature shown in FIG. 1 is the use of indicia 114 for advertising or other purposes. Since a typical arena folding seat 104 is spring loaded to automatically rise into the closed position when the user vacates the folding seat 104, the placement of indicia 114 for advertising or other purposes can be very effective since a patron at a public facility will be constantly exposed to the advertising message whenever the patron glances at an empty folding seat 104 or uses the trash receptacle 106 attached to the arena seat 104. Since the trash receptacle 106 is preferred to be recyclable and disposable, advertising messages can be changed for each event. An advantage of using indicia 114 in this manner is that the advertising revenue may substantially offset the cost of the trash receptacle 106. As a result, the cleanliness of the public facility will be improved with only a marginal, if any, cost attached to the improvement.

Trash 112 is illustrated in trash receptacle 106. The basic trash receptacle does not require any sealing method and may in fact have only a trash aperture 110 which allows trash 112 to be inserted. However, an optional plastic complementary rib and groove seal 510 can be used to avoid accidental spillage. The preferred embodiment uses a zip lock seal 110 because of its low cost and ease of manufacture. Alternative sealing methods, such as hook and loop material, adhesives, etc. can also be used.

An extension flap or suspension means 116 separates trash receptacle 106 from seat attachment 108. The purpose of extension flap 116 is to provide easier access to trash aperture 110 when the folding seat is in the open position. FIG. 1 illustrates the folding seat 104 in the closed position. In this position, extension flap 116 flexes to allow the suspended trash receptacle 106 to fold back towards folding seat 104. In the closed position, indicia 114 is readily visible to patrons of a public facility. As a result, patrons can be exposed to any type of advertising message used by indicia 114. Not only does indicia 114 provide a dual function for trash receptacle 106, but the revenue from the advertising can be used to offset the cost of trash receptacle 106 such that the advantages of cleanliness and convenience to the patron are substantially free to the owner of the public facility. In fact, the advertising revenue may more than cover the cost of trash receptacle 106 such that the owner of the public facility actually makes a profit by providing the benefits of trash receptacle 106 to the patrons.

Figure 2:
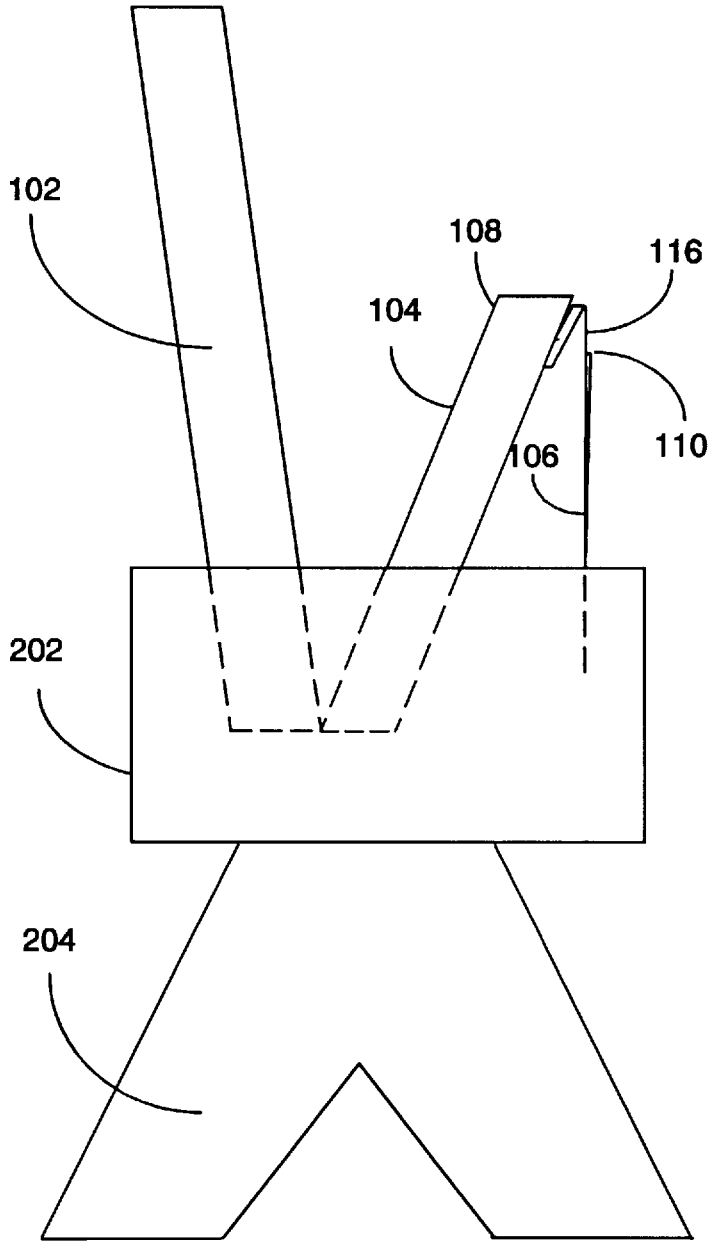
FIG. 2 is a side view of the embodiment of FIG. 1 with the folding seat in the closed position.

FIG. 2 is a side view of folding seat 104 in the closed position. Seat back 102, seat arm 202 and seat legs 204 are also shown. The portions of seat back 102, folding seat 104 and trash receptacle 106 which are behind seat arm 202 are illustrated in dashed lines to show their relative positions. Trash receptacle 106 is shown hanging downwardly from extension flap 116 which is in turn attached to seat attachment 108. In the preferred embodiment, extension flap 116 is formed by extending the rear panel of trash receptacle 106. As can be seen from this figure, when folding seat 104 is in the closed position trash receptacle 106 folds back toward folding seat 104 and is out of the path of the patron or others who are passing arena seat 100. The ability to automatically be removed from the path of the patron when folding seat 104 is in the closed position benefits the patron by avoiding accidental spills which may occur if trash receptacle 106 was located in the path of the patron.

Figure 3:
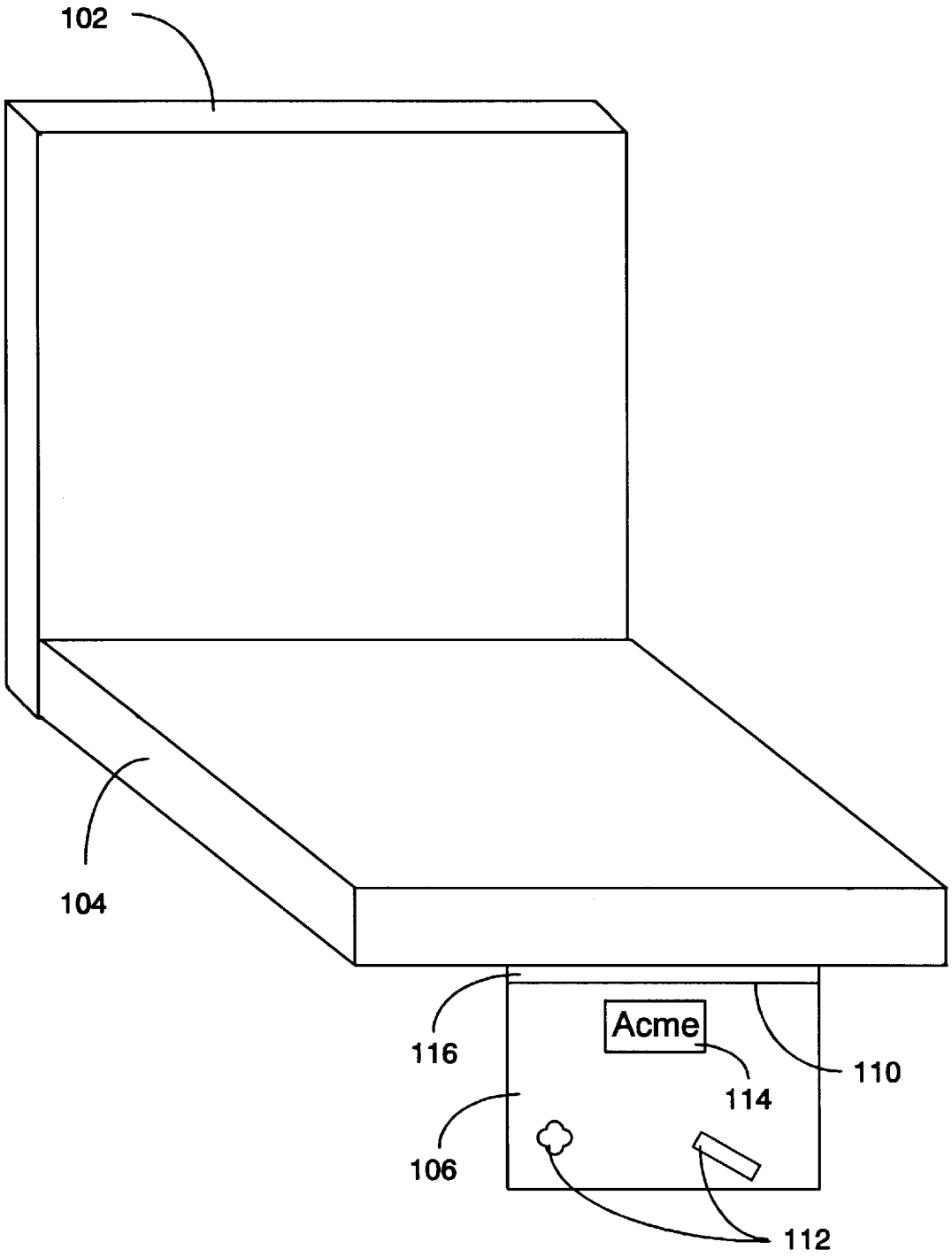
FIG. 3 is a diagram showing a front perspective view of the embodiment of FIG. 1 with the folding seat in the open or lowered position.

FIG. 3 illustrates folding seat 104 in the open position. In the open position, extension flap 116 flexes forward to allow trash receptacle 106 to be conveniently available to the patron. Of course, the closer to the front edge of folding seat 104 that trash receptacle 106 is placed, the easier it is for the patron to reach trash aperture 110.

The advantages of extension flap 116 can be more readily seen when folding seat 104 is in the open position. By separating trash receptacle 106 from seat attachment 108, it is easier for the patron to insert trash 112 into trash receptacle 106.

Figure 4:
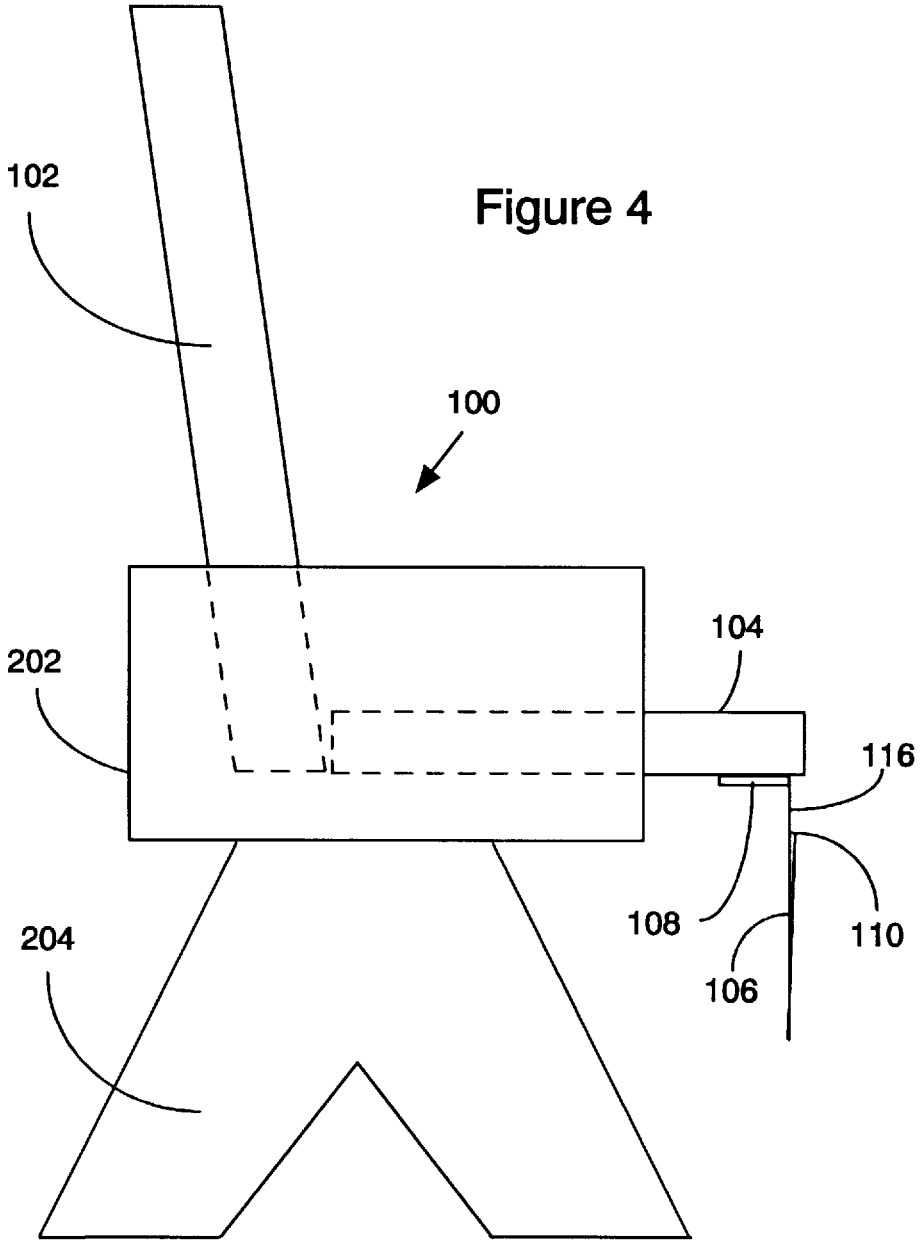
FIG. 4 is a side view of the embodiment of FIG. 1 with the folding seat in the open position.

FIG. 4 is a side view of folding seat 104 in the open position. As was the case in regard to FIG. 2, the portions of seat back 102 and folding seat 104 which are behind seat arm 202 are illustrated in dashed lines to show their relative positions. In the open position, trash receptacle 106 flexes forward away from the bottom of folding seat 104 and is suspended by extension flap 116 and seat attachment 108. As can be readily seen in this view, the closer seat attachment 108 is placed to the forward edge of folding seat 104, the easier it is for a patron to access trash aperture 110. In the preferred embodiment, to facilitate the forward placement of trash receptacle 106, the adhesive on seat attachment 108 is placed on the forward side of seat attachment 108 such that seat attachment 108 is folded back towards the rear edge of folding seat 104 when installed. By folding seat attachment 108 toward the back of folding seat 104 in this manner, trash receptacle 106 is placed in a more forward position in relation to the forward edge of folding seat 104 resulting in easier access to trash aperture 110.

Figure 5:
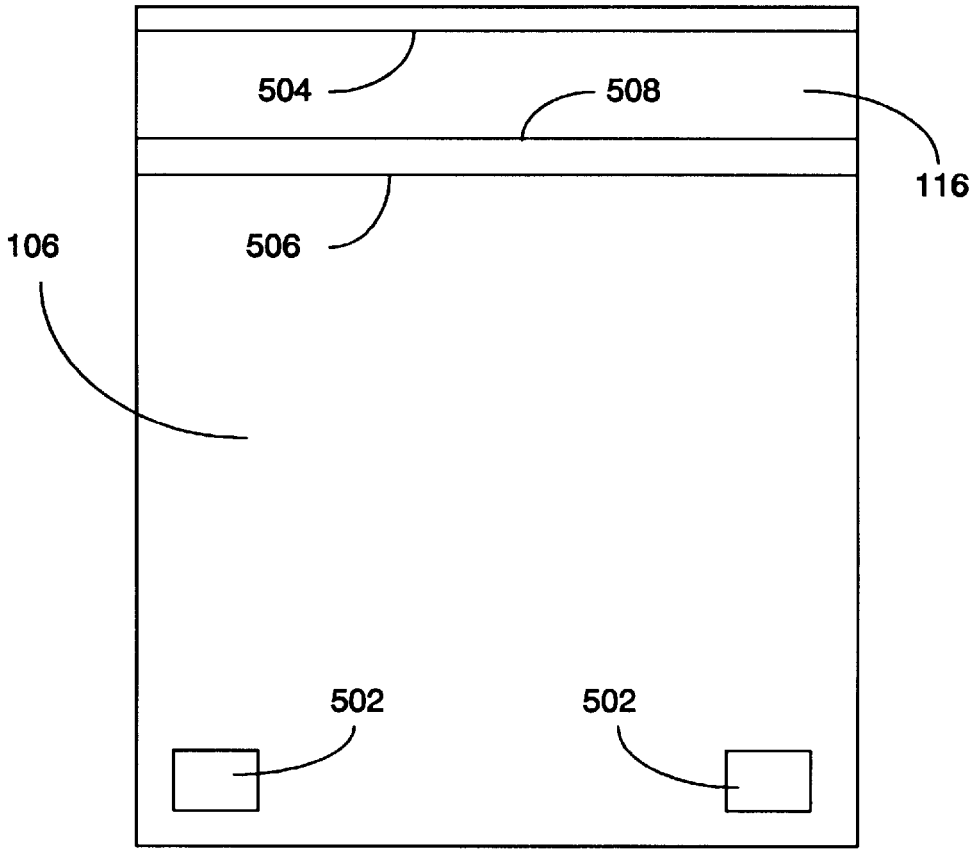
FIG. 5 is a front view of an embodiment of the trash receptacle with a mechanical attachment, a double seal and releasable lower securing means provided by adhesive strips.

FIG. 5 illustrates additional optional features which can be used in conjunction with trash receptacle 106. Optional adhesive strips 502 provide releasable lower securing means which secure the bottom of trash receptacle 106 to the bottom of folding seat 104 and prevent trash receptacle 106 from flexing forward when folding seat 104 is moved into the open position. Adhesive strips 502 provide the patron the advantage of having trash receptacle held in an out of the way location when not desired. When the patron requires the use of trash receptacle 106, then adhesive strips 502 are pulled free of the bottom of folding seat 104 and trash receptacle 106 flexes forward for the patron's convenience.

An optional plastic complementary rib and groove seal 508 is shown where trash aperture 110 would normally be located. Such seals are well known in the art. The advantage of using a seal in connection with trash receptacle 106 is that inadvertent spills may be avoided. Alternative sealing methods may be used in place of zip lock seal 508. For example, hook and loop material, resealing tape, etc. can also be used.

In addition to seal 508, alternative seat attachment 504 and secondary seal 506 are also shown. Alternative seat attachment 504 and secondary seal 506 are explained below in regard to FIGS. 6A–D.

Figure 6A:
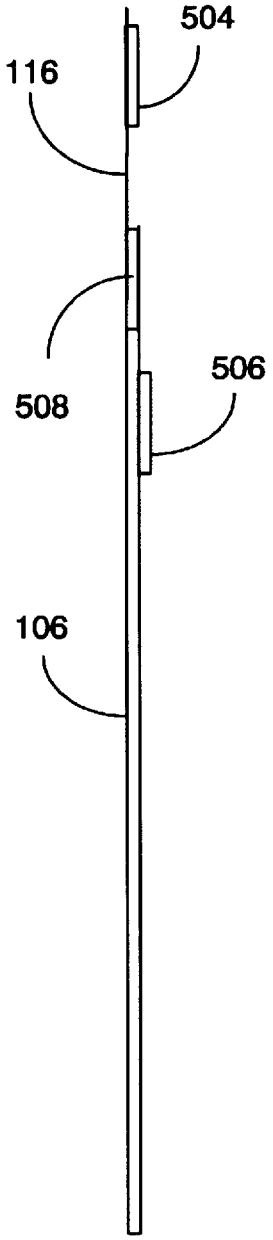
FIG. 6A is a side view of the embodiment of FIG. 5.

FIG. 6A is a side view of trash receptacle 106. This view illustrates seal 508. Seat attachment 504 is shown on the front side of trash receptacle 106 to allow better placement of trash receptacle 106 as discussed above. Seat attachment 504 and secondary seal 506 can be selected from any one of a number of device types. In addition to the adhesive seat attachment 108 discussed above, seat attachment 504 can also be a complementary rib and groove type of attachment device. Of course, the bottom of folding seat 104 would also require a mating connector to allow seat attachment 504 to attach to the bottom of folding seat 104. Secondary seal 506 can be used in conjunction with seat attachment 504 after trash receptacle 106 is removed to provide a double seal for trash receptacle 106. In addition to a zip lock type seal, other alternative methods such as double stick tape, magnetic seals, etc., may also be used for seat attachment 504 and secondary seal 504.

Figure 6B:
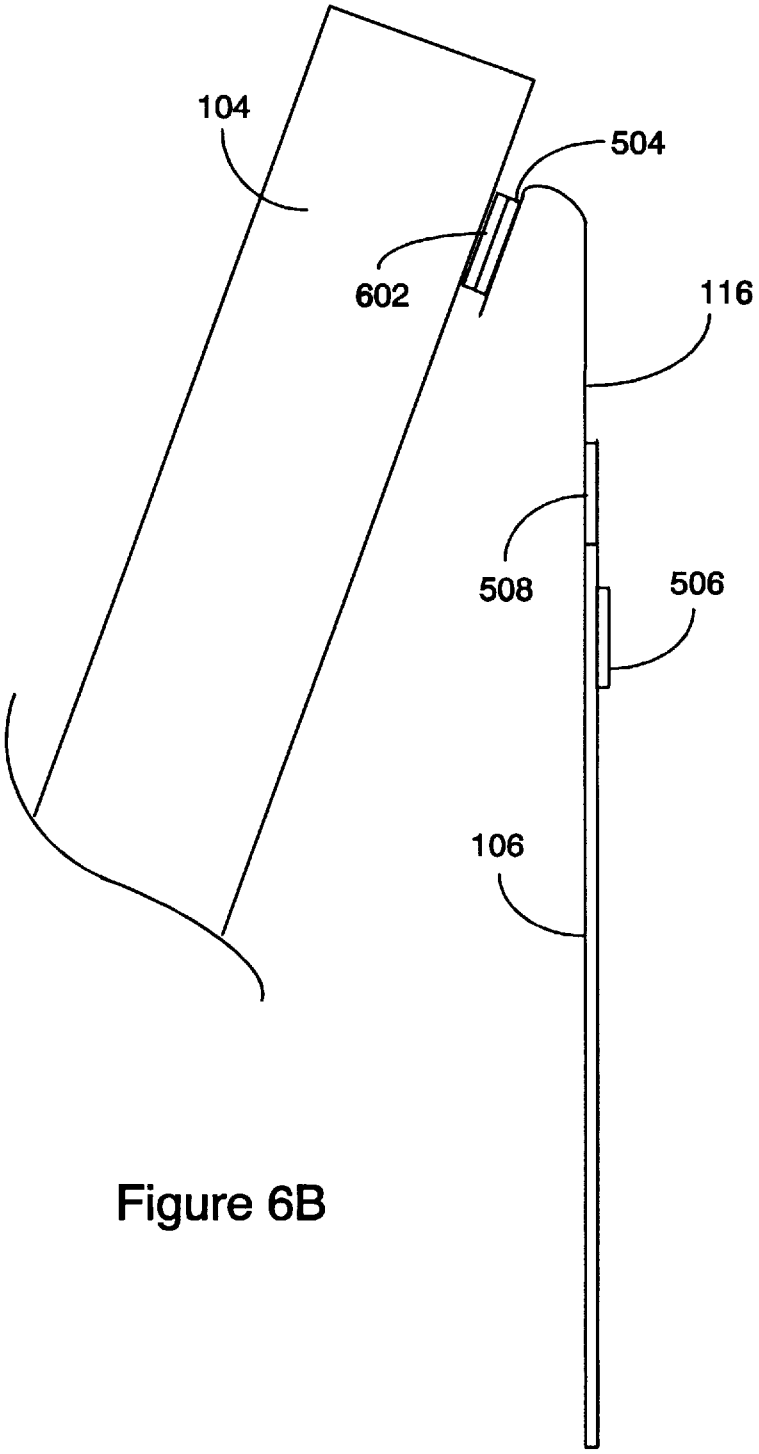
FIG. 6B is a side view of the embodiment of FIG. 5 with the trash receptacle attached to the underside of a folding seat.

FIG. 6B illustrates the embodiment of FIG. 6A when installed on the bottom of folding seat 104. In this figure, seat attachment 504 is attached to securing means 602. If seat attachment 504 is a complementary rib and groove type seal, then securing means 602 would be the mating connector. Likewise, if seat attachment was a magnetic or metallic strip, then securing means 602 would be the corresponding metallic or magnetic strip. Of course, if seat attachment 504 is double sided tape, then securing means 602 would not be needed.

Figure 6C:
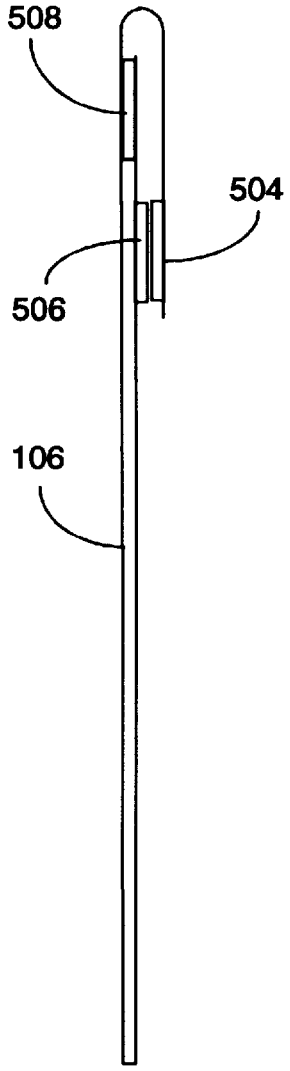
FIG. 6C is a side view of the embodiment of FIG. 5 with the trash receptacle sealed by the trash container seal and a dual seal formed by the seat attachment means.

FIG. 6C illustrates the embodiment of FIG. 6B after trash receptacle 106 is removed from folding seat 104. In this position, seat attachment 504 is folded over to join with secondary seal 506 to provide an additional seal which further avoids accidental spillage.

Figure 6D:
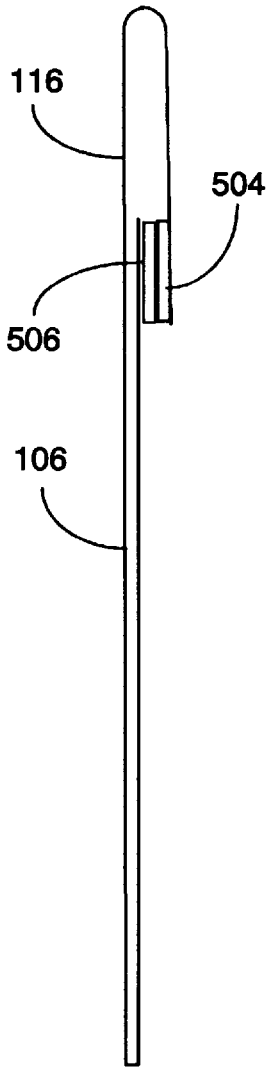
FIG. 6D is a side view of an alternative embodiment which uses the seat attachment means as the seal for the trash receptacle.

FIG. 6D illustrates an alternative embodiment which uses seat attachment 504 in conjunction with secondary seal 506 to provide a sealing mechanism for trash receptacle 106 after trash receptacle 106 is removed from folding seat 104. The advantage of this embodiment is that trash receptacle 106 is less expensive to manufacture. If resealable tape or a reusable adhesive is used for seat attachment 504, then secondary seal 506 can be eliminated, resulting in a sealable trash receptacle with an even more efficient design.

Figure 7:
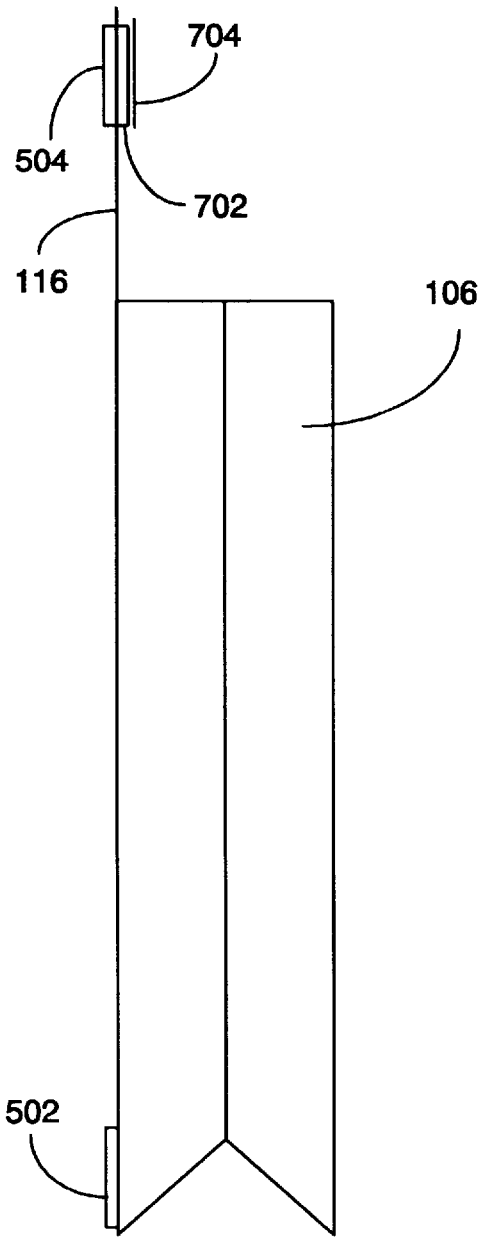
FIG. 7 is a side view of an alternative embodiment which uses an expandable trash bag and a rear mounted attachment adhesive strip.

FIG. 7 illustrate an alternative embodiment which used a bellows-type structure to provide a trash receptacle 106 with increased capacity. In addition, this embodiment places the seat attachment and adhesive strips 502 on the rear side of extension flap 116. This configuration is useful when trash receptacle 106 is to be mounted on an upright surface such as the fixed back 102 in front of the patron or on the front edge side of the folding seat. By using adhesive strips 502 in conjunction with seat attachment 504, trash receptacle 106 is held securely against fixed back 102 or the front edge side of the seat which reduces obstruction of the path in front of the patron's seat and further reduces the chance of inadvertently knocking trash receptacle 106 loose.

Trash seal 702 is provided to allow trash receptacle 106 to be sealed after use. In the preferred embodiment, trash seal 702 is a double stick tape which has a discardable cover 704. When trash receptacle 106 is removed, cover 704 is taken off, extension flap 116 is folded over, and trash seal 702 is sealed to the front surface of trash receptacle 106 to seal the contents of trash receptacle 106. Alternative sealing devices, such as a complementary rib and groove seal, may be used for trash seal 702.

Figure 8A:
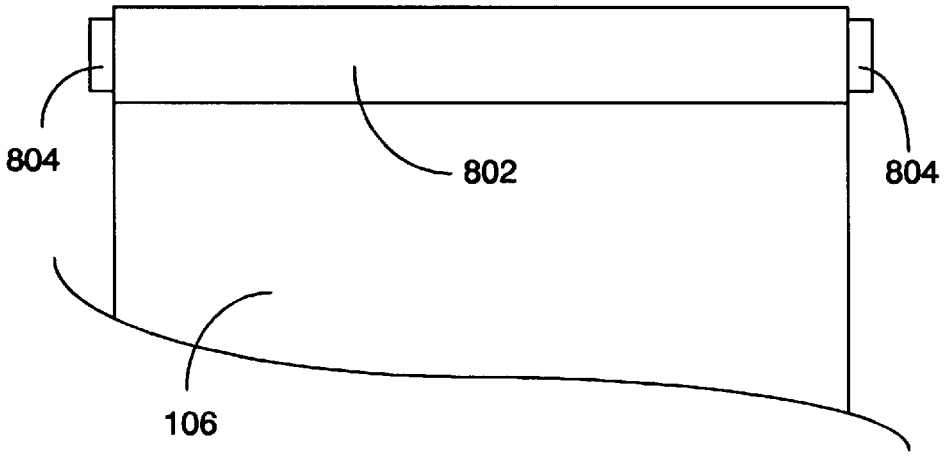
FIG. 8A is a front view of an alternative embodiment which uses a support rod. An integral sleeve mounts over the support rod and holds the trash receptacle in place.

FIG. 8A is a front view of an alternative embodiment of trash receptacle 106. In this embodiment, trash receptacle 106 has a sleeve 802 formed in an extension where extension flap 116 and seat attachment 108 were in the previous embodiments. Sleeve 802 is mounted on a support rod 804.

Figure 8B:
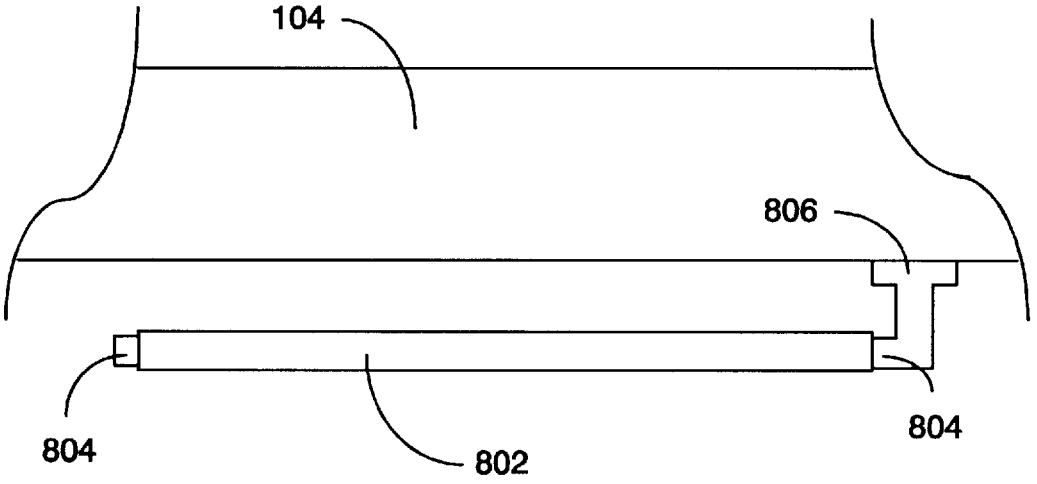
FIG. 8B is a top view of the embodiment of FIG. 8A.

FIG. 8B is a top view of the embodiment of FIG. 8A. This view illustrates support rod 804 mounted to folding seat 104 via mount 806.

Figure 9:
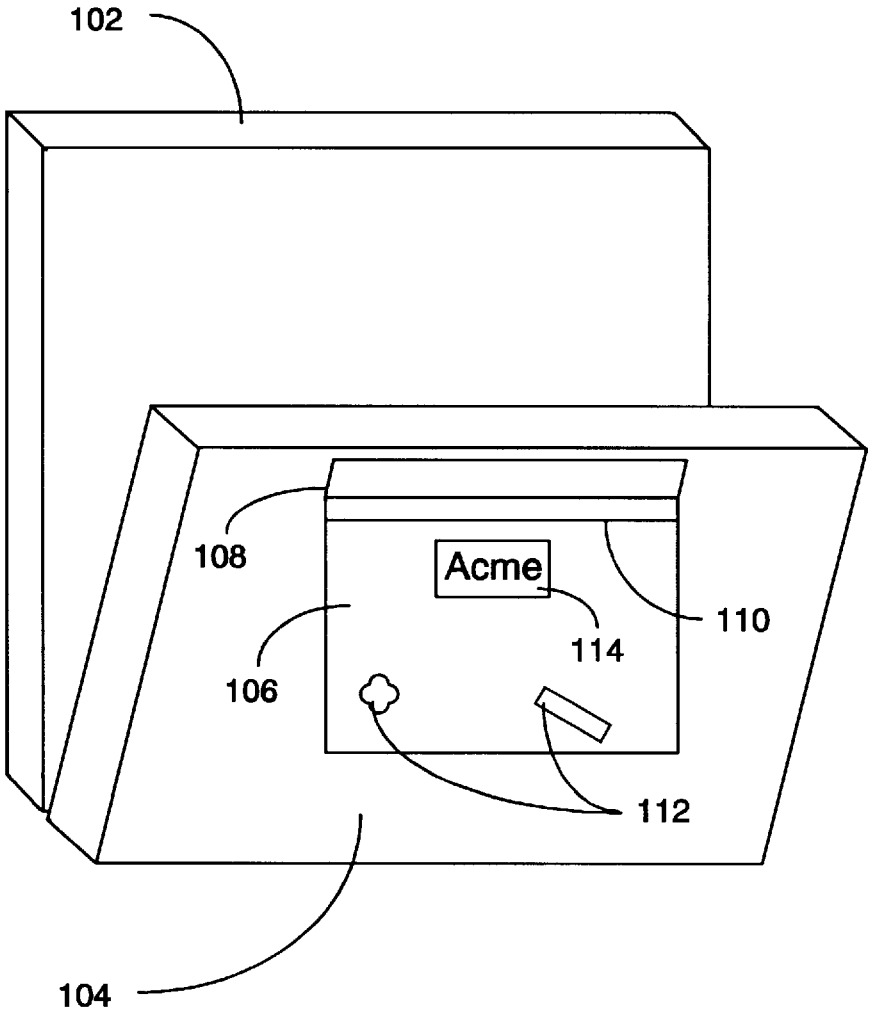
FIG. 9 is a diagram showing a front perspective view of an alternative preferred embodiment of the trash receptacle with the adhesive used by the adhesive seat attachment mounted on the rear surface of the trash receptacle.

FIG. 9 illustrates an alternative embodiment which locates the seat attachment on the rear of trash receptacle 106. As can be seen when compared to the embodiment of FIG. 1, this embodiment does not allow trash receptacle 106 to be mounted as close to the edge of folding seat 104 when trash receptacle 106 is attached to the bottom of folding seat 104. However, this embodiment provides the most forward positioning if trash receptacle 106 is attached to the front edge of folding seat 104 rather than to the bottom of folding seat 104.

Figure 10:
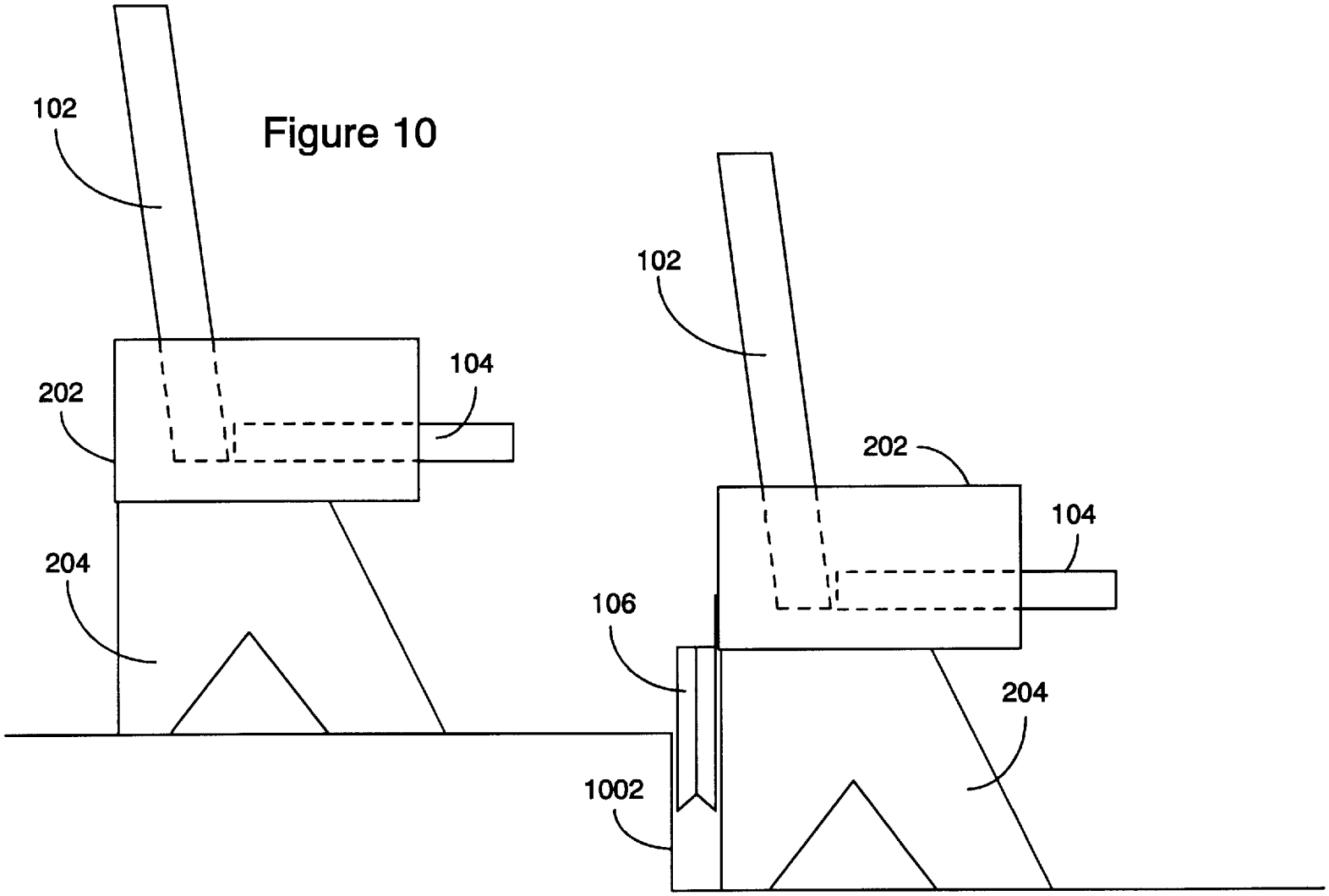
FIG. 10 is another alternative embodiment in which the trash receptacle is attached to the rear of the seat in front of the patron with the lower portion of the trash receptacle fit between the seat back and a stepped floor.

In FIG. 10, an alternative embodiment is shown in which trash receptacle 106 is mounted on fixed back 102 of the seat in front of the patron. As was the case in regard to FIGS. 2 and 4, the portions of seat backs 102 and folding seats 104 which are behind seat arms 202 are illustrated in dashed lines to show their relative positions. This embodiment is useful for public seating which uses stepped floors. Where stepped floors are used, trash receptacle 106 can be inserted behind the step 1002 such that trash receptacle 106 is protected from inadvertently being knocked loose when a patron is passing by. Any suitable securing means, including adhesive strips 502 can be used to secure trash receptacle 106 to fixed back 102.

While the invention has been described with respect to a preferred embodiment thereof, it will be understood by those skilled in the art that various changes in detail may be made therein without departing from the spirit, scope, and teaching of the invention. For example, a variety of seat attachment means can be used including adhesives, double stick tape, magnetic strips, complementary rib and groove seals, hook and loop, mechanical devices such as clamps, support rods, hooks, etc., a variety of materials can be used to manufacture trash receptacle 106 such as polyethylene, polypropylene, plastic, paper, etc. Accordingly, the invention herein disclosed is to be limited only as specified in the following claims.

There has thus been disclosed an assembly for improving the cleanliness of a facility which includes folding seats, a receptacle for each seat, and means for removably suspending a receptacle from each seat. Further, there has been disclosed a system for improving the cleanliness of a facility which includes the steps of providing folding seats for patrons, forming a receptacle for each seat and suspending a receptacle from each seat.

I claim:

1. An assembly for improving the cleanliness of a facility without interfering with patron traffic, including;

(a) seats for patrons which fold between a raised and a lowered position, each seat having an upper seating side, a lower underside, and a front edge side;

(b) a receptacle for each seat having a front panel and a rear panel defining an aperture near the top of each receptacle for receiving trash; and (c) means for removably and freely pivotably suspending the aperture end of a receptacle from each seat, whereby when a seat is moved to a raised position said receptacle automatically freely pivots back against said underside of a seat thus removing said receptacle from the path of a patron and where the receptacle is clearly visible to a patron about to use said seat, and whereby when said seat is moved to a lowered position said receptacle automatically freely pivots forward to a downwardly hanging position from said seat to enable access to said receptacle by a patron in said seat, said freely pivotable suspension keeping said aperture end upwardly to prevent trash from falling out of said receptacle enabling collection and disposal of receptacles without trash falling out.

2. An assembly as defined in claim 1 in which said suspending means includes an extension having front and rear surfaces extending upwardly from said rear panel of said receptacle.

3. An assembly as defined in claim 2 in which said removable suspending means further includes adhesive means attached to a front surface of said extension for adhering said extension to an underside of a folding seat.

4. An assembly as defined in claim 2 in which said removable suspending means further includes adhesive means attached to a rear surface of said extension for adhering said extension to a front edge side of a folding seat.

5. As assembly as defined in claim 1 in which said suspending means includes (a) support means mounted to and extending below a folding seat; and wherein (b) said receptacle has an extension extending upwardly therefrom which has a sleeve formed therein enabling said receptacle to be removably suspended from said support means.

6. An assembly as defined in claim 1 in which said receptacle has indicia formed on the front panel of said receptacle.

7. An assembly as defined in claim 1 which further includes releasable lower securing means attached to the rear panel of the receptacle whereby the receptacle is prevented from moving to a downwardly hanging position when the seat is moved to a lowered position.

8. A system for improving the cleanliness of a facility without interfering with patron traffic, including the steps of:

(a) providing seats for patrons which fold between a raised position and a lowered position, and in which said seats have an upper seating side, a lower underside, and a front edge side;

(b) forming a receptacle for each seat which has a front panel and a rear panel which define an aperture near the top of each receptacle for receiving trash; and (c) removably and freely pivotably suspending the aperture end of a receptacle from each seat, whereby when a seat is moved to a raised position said receptacle automatically freely pivots back against said underside of a seat thus removing said receptacle from the path of a patron and where the receptacle is clearly visible to a patron about to use said seat, and whereby when said seat is moved to a lowered position said receptacle automatically freely pivots forward to a downwardly hanging position to enable access to said receptacle by a patron in said seat, said freely pivotable suspension keeping said aperture end upwardly to prevent trash from falling out of said receptacle enabling collection and disposal of receptacles without trash falling out.

9. A system as defined in claim 8 which further includes a step of forming an extension having front and rear surfaces which extends upwardly from said rear panel of said receptacle to enable suspending a receptacle from each seat.

10. A system as defined in claim 9 which further includes the step of attaching adhesive means to a front surface of said extension for adhering said extension to an underside of a folding seat.

11. A system as defined in claim 9 which further includes the step of attaching adhesive means to a rear surface of said extension for adhering said extension to a front edge side of a folding seat.

12. A system as defined in claim 8 in which said step of suspending a receptacle from each seat further includes (a) mounting a support means to and extending below a folding seat, and (b) forming an extension extending upwardly from said receptacle which has a sleeve formed therein enabling said receptacle to be removably suspended from said support means.

13. A system as defined in claim 8 which further includes forming indicia on the front panel of said receptacles.

14. A system as defined in claim 8 which further includes the step of attaching releasable lower securing means to the rear panel of the receptacle whereby the receptacle is prevented from moving to a downwardly hanging position when the seat is moved to a lowered position.

* * * * *